US005643182A

United States Patent [19]

Engel

[11] Patent Number: 5,643,182

[45] Date of Patent: Jul. 1, 1997

[54] ROLLER MASSAGER

[76] Inventor: James E. Engel, 8148 Genesee Ave., No. 58, San Diego, Calif. 92122

[21] Appl. No.: 543,804

[22] Filed: Oct. 16, 1995

[51] Int. Cl.[6] ..... A61H 15/00

[52] U.S. Cl. ..... 601/119; 601/122; 601/123

[58] Field of Search ..... 601/99–103, 115, 601/118–119, 120, 122, 123, 125, 126, 127, 128, 129, 130, 131, 132

[56] References Cited

U.S. PATENT DOCUMENTS

| | | | |
|---|---|---|---|
| 2,461,102 | 2/1949 | Ackerman | 601/99 |
| 2,895,470 | 7/1959 | Reiter | 601/122 |
| 3,079,914 | 3/1963 | Bush | 601/122 |
| 3,583,396 | 6/1971 | Landis | 601/125 |
| 3,645,256 | 2/1972 | Morrison | 601/122 |
| 3,759,250 | 9/1973 | Salata | 601/122 |
| 3,814,085 | 6/1974 | Kupchinski | 601/122 |
| 5,472,408 | 12/1995 | Yates | 601/119 |

FOREIGN PATENT DOCUMENTS

| | | | |
|---|---|---|---|
| 1388040A1 | 8/1988 | U.S.S.R. | 601/122 |

*Primary Examiner*—Robert A. Hafer
*Assistant Examiner*—Benjamin K. Koo
*Attorney, Agent, or Firm*—Gilliam, Duncan & Harms

[57] ABSTRACT

An apparatus for applying rolling massaging pressure to opposite sides of a bodily extremity. Two parallel tension rods extend through two spaced shafts having massaging rollers rotatably mounted on the shafts between the tension rods. One shaft is fixed in use to the tension rods and compression springs on ends of the tension rods beyond the second shaft bias the shaft mounted rollers toward each other. At least one shaft has extended ends to act as handles for manipulating the apparatus. The initial distance between the rollers can be adjusted before use. A latch is provided to hold the rollers well apart during insertion of a bodily extremity between the rollers, then release to allow the compression spring loaded pressure to be applied.

19 Claims, 2 Drawing Sheets

ROLLER MASSAGER

BACKGROUND OF THE INVENTION

This invention relates in general to apparatus for massaging parts of the human body and, more specifically, to a versatile roller massager for massaging body areas and extremities, e.g. arms, legs, torso and back.

Massage has long been used to relax and firm muscles and to relieve muscle cramps and other painful muscle conditions. A variety of devices have been developed to permit a user to manually massage various parts of the body. Many of these use rollers that can be moved over the body, often pressed by springs to provide a firm but yielding pressure. The rollers may be manually pressed against the body or may be mounted in a frame so that an am or leg can be inserted between opposed rollers.

Typical of these prior roller massagers which surround an extremity are those described by Landis in U.S. Pat. No. 3,583,396, Salata in U.S. Pat. No. 3,759,250 and Kupchinski in U.S. Pat. No. 3,814,085. Each of these mounts a plurality of rollers on axles mounted in a frame, with opposed rollers biased toward each other by tension springs.

The biasing force and the distance between opposed rollers before a body part is inserted therebetween are not adjustable in the Kupchinski and Landis devices, and the distance is changeable in the Salata device only by removing and reinstalling roller and tensioning spring assemblies. Thus it is difficult and inconvenient to adjust roller pressure to accommodate extremities of different diameters or to provide light pressure on painful areas while providing heavier pressure and deeper massage against well conditioned areas.

Further, it is often difficult to insert the extremity between the rollers, since the body part must force the rollers apart. For example, where a knee is painful due to arthritis or the like, the prior art assemblies will be painful to use, since they must be rolled over the knee while pressing against the knee to reach the thigh to massage the thigh muscles.

In addition, many of these prior massaging devices are difficult or inconvenient to hold and move along the extremity being massaged.

Thus, there is a continuing need for improved roller massagers using opposed spring-loaded rollers that permit easy and convenient adjustment of tension, provide improved manipulation convenience and accuracy with easily grasped and manipulated handles, which permit the spacing between rollers to be easily changed and which allow the rollers to be locked well apart during insertion of a bodily extremity between the rollers.

SUMMARY OF THE INVENTION

The above-noted problems, and others, are overcome in accordance with this invention by a roller massaging apparatus for massaging opposite surfaces of a bodily extremity that basically comprises two spaced elongated shafts, two parallel tension rods extending through the shafts and massage rollers around the shafts between the tension rods. The massage rollers are rotatable relative to the shafts. One of the shafts is releasably locked to the tension rods and the other is moveable along the rods. Compression springs are provided on the ends of the tension rods beyond the movable shaft to bias the movable shaft toward the fixed shaft. When an extremity, such as a leg or arm, is moved between the massage rollers, the compression spring presses the rollers against the opposite sides of the extremity. At least one Of the shafts has handle extensions so that the assembly can be moved along the extremity.

The massage rollers may have any suitable shapes. Typically, the rollers may have straight cylindrical surfaces, concave or convex surfaces (either V-shaped, rounded concave or convex shapes. etc.). Several independent massager rollers may be placed along a shaft, with the shaft bent to form an overall concave configuration, if desired.

A latch mechanism is preferably provided to permit the rollers to be releasably latched in a spaced apart position while a bodily extremity or the torso is being inserted between the rollers. Once the assembly is positioned, the latch is released and the rollers are compression spring pressed against the extremity. The latch mechanism and roller positioning devices may be actuated by manual, mechanical, pneumatic, hydraulic or electrical means

BRIEF DESCRIPTION OF TIME DRAWING

Details of the invention, and of preferred embodiments thereof, will be further understood upon reference to the drawing, wherein.

DETAILED DESCRIPTION OF PREFERRED EMBODIMENTS

Figure 1:
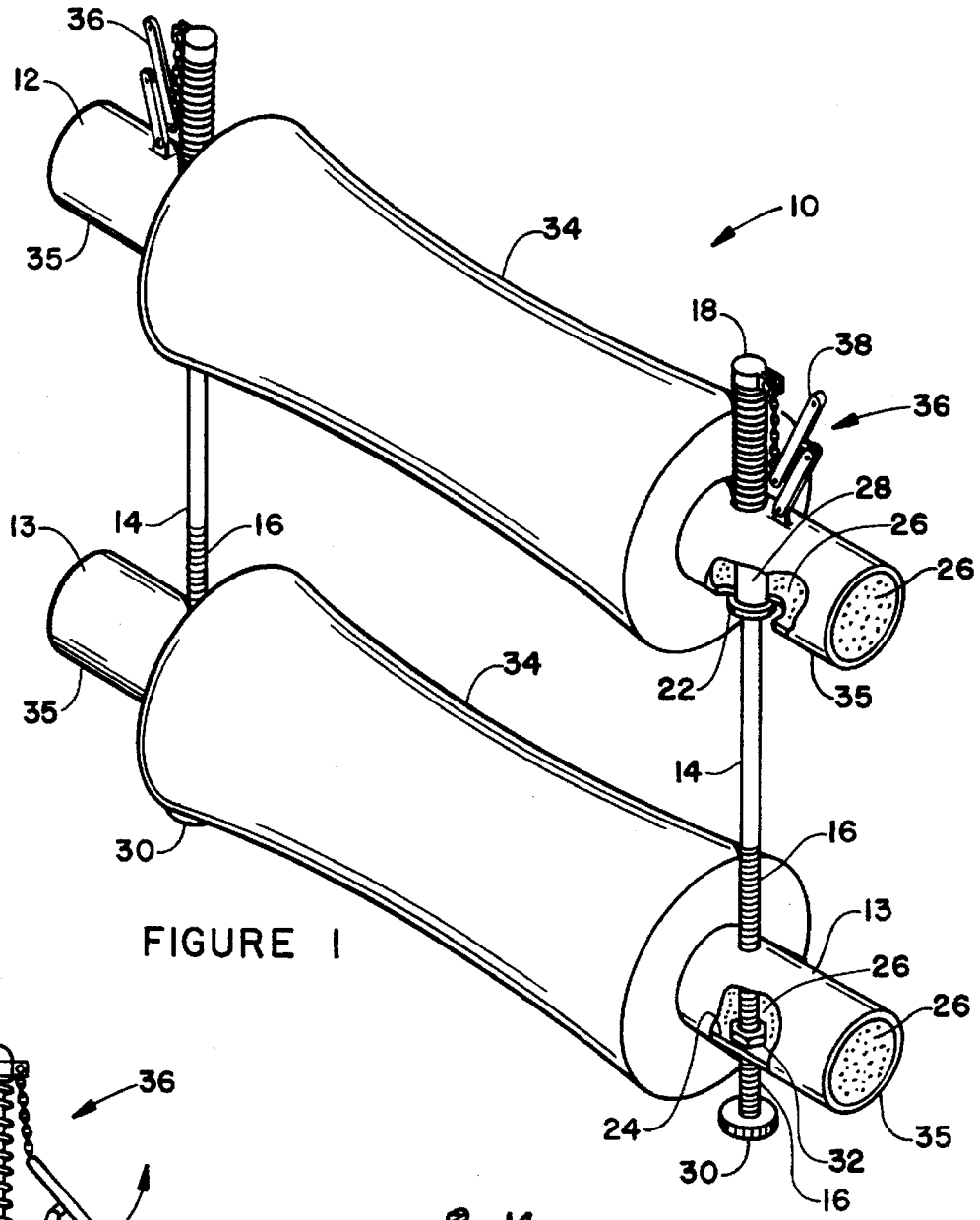
FIG. 1 is a front elevation view of a first embodiment of my roller massager.
Figure 2:
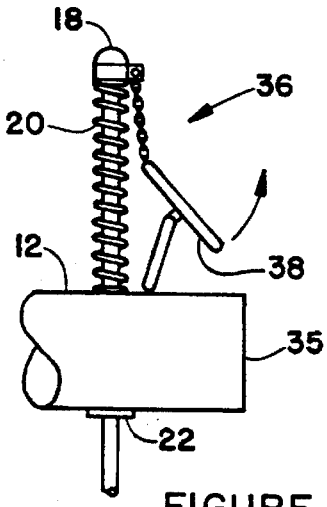
FIG. 2 is a detail elevation view of the spring compression latch of FIG. 1 in the latched position.

Referring to FIGS. 1 and 2, there is seen a roller massager apparatus 10 basically comprising second and first shafts 12 and 13, respectively, which are parallel in this embodiment, with two substantially parallel tension rods 14 passing through them.

Tension rods 14 are threaded along lower portions 16 and have heads 18 on the second end to retain compression springs 20 bearing on the upper surface of second shaft 12. Retainers 22, such as rubber bushings, frictionally engaging clips or the like are preferably placed around each tension rods 14 to prevent shaft 12 from slipping down the rods.

Shafts 12 and 13 may be formed from any suitable material. Typically, these shafts may have a tubular outer wall 24, formed from polyvinyl chloride or the like, which may be filled with a material 26 that will stiffen the shafts, such as hardwood dowels, plastic rods, plastic potting material, metal, etc. If desired, sleeves 28 may be inserted in holes through shafts 12 and/or 13 through which tension rods 14 can pass.

The position of first shaft 13 along tension rods 14 is adjustable by rotating tension rods 14 with knobs 30, with the threaded portions 16 of tension rods 14 passing through threaded nuts 32 imbedded in and secured to (such as by adhesive bonding) tube 24 and/or filler 26. Where a filler is used, nuts 32 are preferably embedded in the filler, as shown. If only a tube is used, nuts 32 would be secured to the outer tube wall, just below the position shown.

Rollers 34 surround central portions of shafts 12 and 13 and are rotatable relative thereto. Simple sliding bearings, which can be lubricated if desired are preferred. Other bearings, such as roller or ball bearings could be used if desired. Rollers 34 may be formed from any suitable material, such as wood, solid plastic, plastic foam of selected density, etc. For best results, a solid handle 35 covered with a foam-surfaced roller 34 is preferred because of the ability of the foam to conform to small irregularities across the body portion being massaged. Rollers 34 may have any suitable surface configuration, such as cylindrical, concave as shown in FIG. 1, convex, concave V-shaped, etc. For most effective massage, a rounded concave surface is preferred.

In use, an extremity, such as an arm or leg, is placed between rollers 34 and knobs 30 are rotated to rotate tension rods 14 and provide the desired massage pressure, compressing springs 20 to a desired extent. The ends of at least one of shafts 12 and 13 extend beyond tension rods 14 to provide convenient handles 35 that are gripped and the massage assembly is moved back and forth along the extremity. The result is a vigerous rolling massage of the underlying muscles.

Figure 3:
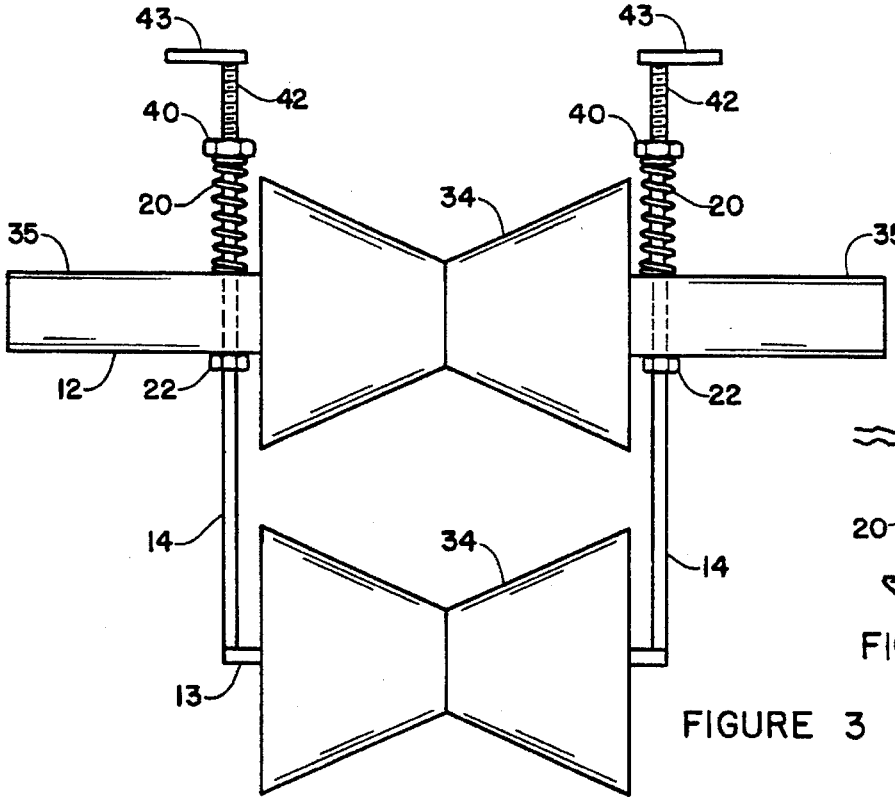
FIG. 3 is a front elevation view of a second embodiment of my roller massager.

A second embodiment of my roller massager, having a different configuration but operating in the same manner, is shown in front elevation in FIG. 3.

Second shaft 12 is basically the same as described above. The ends of first shaft 13 here are secured to lower ends of tension rods 14. First shaft preferably is formed from metal and is welded to tension rods 14, or the combination of tension rods and shaft could be formed from a single rod by bending the rod to the configuration shown after installation of the lower roller. Alternately, first shaft could be similar to shaft 13 of FIG. 1 and could be bolted to tension rods 14, using any suitable connecting bracket at the connection.

Rollers 34 can have any suitable external shape, such as the concave V-shape shown, a rounded concave shape as shown in FIG. 1, a cylindrical or convex shape, etc.

Figure 5:
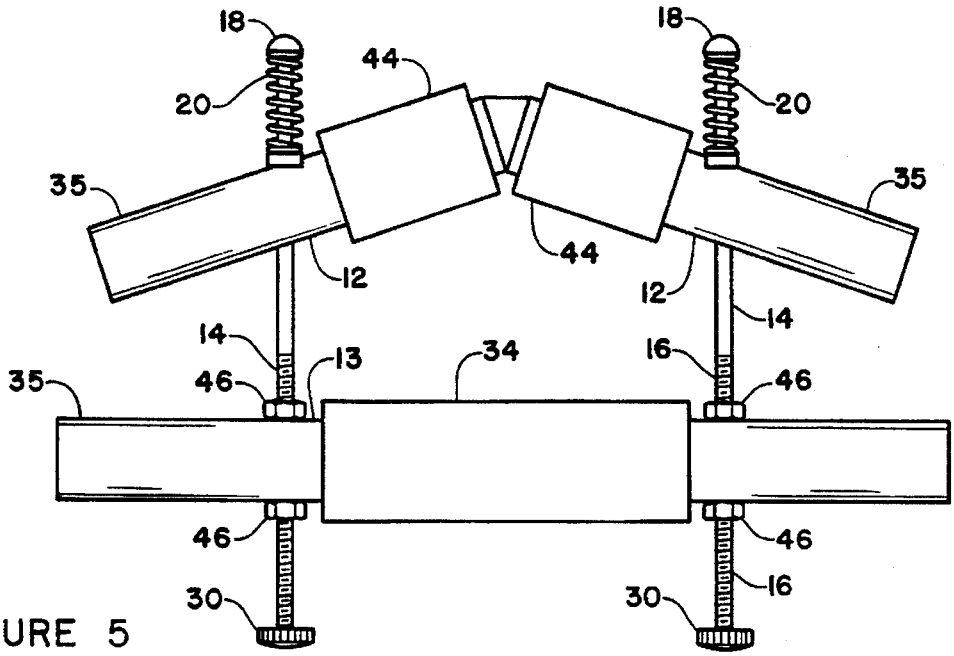
FIG. 5 is a front elevation view of a third embodiment of my roller massager.

Over-center latches 36 provide a convenient means for rapidly moving the rollers apart during insertion of an extremity therebetween and returning them to an exact pre-set position for massaging. By moving lever 38 from the position shown in FIG. 2 to the position shown in the view of FIG. 1, spring 20 is fully compressed so that shaft 12 and second roller 34 are moved well away from lower roller 34. The over-center characteristics of the latch will hold the latch in position during installation of the assembly on an extremity. Once the assembly is positioned at the massage location, lever 38 is moved back to the position shown FIG. 2 so that rollers 34 move together and the massage is begun by moving the assembly along the extremity with the extended handle portions 35. A similar over-center latch mechanism may be used with the embodiments of FIGS. 3 and 5, if desired, with the latches connected between roller 12 and the upper ends of threaded portions 42 (FIG. 3) or heads 18 (FIG. 5).

In the embodiment of FIG. 3, the adjustment of the space between the rollers is accomplished through nuts 40 threaded onto threaded upper portions 42 of tension rods 14 and engaging the upper ends of compression springs 20. Turning adjustment nuts 40 downwardly will decrease spacing between rollers 34 and increase pressure provided by upper roller 34 on an extremity between the rollers. Retainers 22 frictionally engage tension rods 14 and will move downwardly with roller when nuts 40 are moved downwardly, but will prevent shaft 12 from dropping below the lowermost position produced by springs 20. If desired handles may also be attached to tension rods 14 along the sides between the rollers 34, if desired as another means for manipulating the assembly.

When, for example, a leg is to be massaged, it may be desirable to move rollers 34 apart until they have passed an ankle, then move them together to massage the calf area. This movement could be accomplished by moving nuts 40 upwardly to move rollers 34 apart, then rotating the nuts downwardly to bring rollers 34 closer together and provide the massaging pressure.

Figure 4:
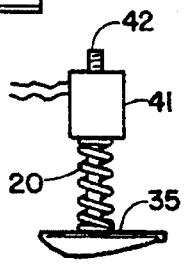
FIG. 4 is a detail elevation view of a power drive mechanism for roller adjustment.

As seen in the detail view of FIG. 4, a small electric motor could be placed over threads 40 on each tension rod 14 to drive nuts 40 (as seen in FIG. 3, not seen in FIG. 4) upwardly and downwardly under control of a conventional electrical switch, not shown.

While the massager will ordinarily be hand-held and manipulated, if desired, brackets 43 may be secured to the ends of threaded portions 42 of tension rods 14 as seen in FIG. 4 so that the assembly could be secured to a wall or floor by bolts, screws or the like.

FIG. 5 illustrates a third embodiment of the roller massager of this invention. This embodiment is generally similar to that of FIG. 1, with two tension rods 14, a first shaft 13 and roller 34. Here, however, second shaft 12 is in a broad V-shape, with the concave side oriented toward first shaft 13. Two rollers 44 are positioned on shaft 12, rotatable relative thereto. First shaft 13 is held in position along tension rods 14 in this case by upper and lower nuts 46 abutting and secured (such as by an adhesive or welding) to shaft 13. First shaft 13 can be moved closer to, and further from, second shaft 12 by rotating knobs 30 to turn threaded portion 16 in nuts 46. If desired, both second and first shafts could have a concave V-shape, or the included angle of the V-shape could be varied.

In a complete kit different shafts, different rollers of the sort shown in FIGS. 1, 3 and as upper roller 44 in FIG. 5 could be supplied and interchanged on one set of tension rods 14 by the user.

Figure 6:
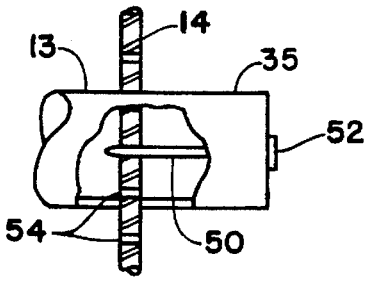
FIG. 6 is a detail view of an alternate tension rod locking mechanism.

An alternate mechanism for locking tension rods 14 at different positions relative to first shaft 13 so as to set different spacings between rollers 34 is schematically illustrated in the detail view of FIG. 6, with portions cutaway to show internal components. Here, a pin 50 having a movable head 52 is inserted in an opening from the end of a solid shaft 13 to the transverse hole through which tension rod 14 passes. A plurality of transverse holes 54 in tension rod 14 are sized to match the end of pin 52, so that the pin can be withdrawn, moved to align the end of pin 50 with a selected hole 52 and pushed in to lock the shaft 13 position along rod 14. Pin 52 may be spring loaded in a conventional manner toward tension rod 14, may be held in place by friction or any other suitable means may be used to releasably hold pin 50 in the selected hole 54 during use of the massager. While the threaded rod 16, knob 30 and nut 46 adjustment means shown in FIGS. 1 and 5 and the pin 50 and holes 54 means of FIG. 6 are preferred, any other suitable adjustment means may be used, if desired.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A roller massager for simultaneously massaging opposite sides of bodily extremities, torso and back which comprises:

first and second spaced elongated shafts;

two spaced generally parallel tension rods penetrating through said first and second shafts;

at least one massage roller surrounding a central portion of each of said first and second shafts between said tension rods;

said massage rollers being rotatable relative to said shafts;

at least one of said first and second shafts having handle portions extending beyond tension rod penetration locations;

said first shaft being lockable to said tension rods at a selected position;

said second shaft being slidable along said tension rods; and compression spring means for biasing said second shaft toward said first shaft.

2. The roller massager according to claim 1 wherein said first and second shafts have substantially straight axes and said massage rollers have a generally cylindrical outer surface.

3. The roller massager according to claim 1 wherein said tensions rods have threaded portions extending through said first shaft and said first shaft is locked in said selected position by two nuts along said tensions rods engaging opposite sides of said first shaft.

4. The roller massager according to claim 1 wherein said tensions rods have threaded portions extending through said first shaft and said first shaft is locked in said selected position by one nut along each of said tensions rods fastened to said first shaft and further including means for rotating said tension rods to move said first shaft relative to said tension rods.

5. The roller massager according to claim 1 wherein each of said tension rods has a plurality of transverse holes in a tension rod portion passing through said first shaft and further including pin means in said first shaft for engaging selected ones of said holes to releasably lock said first shaft in a selected position along said tension rods.

6. The roller massager according to claim 1 wherein at least one of said massage rollers has a concave surface.

7. The roller massager according to claim 1 wherein said second shaft is integral with said tension rods in a generally U-shaped configuration.

8. The roller massager according to claim 1 further including retainer means movable along said tension rods between said first and second shafts for engaging said second shaft and restricting movement of said second shaft toward said first shaft.

9. The roller massager according to claim 1 wherein said compression spring means includes a compression spring surrounding each of said tension rods along tension rod ends extending beyond said second shaft opposite said first shaft, each said compression spring having a first end engaging said second shaft and a second end engaging a nut threaded onto said tension rods.

10. The roller massager according to claim 1 further including electric motor means for rotating said nuts on said tension rods in either direction to vary compression in said compression spring.

11. The roller massager according to claim 1 further including latch means for increasing distance between said first and second shafts, including means for moving said second shaft in a direction compressing said compression spring means, and for releasably locking said second shaft in the resulting position, whereby a bodily extremity may be more easily extended between said first and second shafts.

12. The roller massager according to claim 11 wherein each of said latch means comprises an over-center latch having two ends and an intermediate length movable between long and short positions, one of said ends attached to said second shaft and another of said ends attached to a head on each said tension rod engaging said compression spring opposite said second shaft.

13. The roller massager according to claim 1 further including brackets for mounting said roller massager to a fixed structure.

14. A roller massager for simultaneously massaging opposite sides of bodily extremities, torso and back which comprises:

first and second spaced elongated shafts;

two spaced generally parallel tension rods penetrating through said first and second shafts;

at least one massage roller surrounding a central portion of each of said first and second shafts between said tension rods;

said massage rollers being rotatable relative to said shafts;

at least one of said first and second shafts having handle portions extending beyond tension rod penetration locations;

said first shaft being lockable to said tension rods at a selected position;

said second shaft being slidable along said tension rods; compression spring means for biasing said second shaft toward said first shaft; and latch means for moving said second shaft from a first position along said tension rods to a second position spaced a greater distance from said second tension rod and releasably locking said second shaft in said second position.

15. The roller massager according to claim 14 wherein said latch means comprises over-center latches each having two latch ends and an intermediate length, each said latch movable between long and short positions, a first end of each said latches attached to said second shaft and a second end of each latch attached to an end of said tension rod extending beyond said compression spring.

16. The roller massager according to claim 15 wherein each of said tension rods has a plurality of transverse holes in a tension rod portion passing through said first shaft and further including pin means in said first shaft for engaging selected ones of said holes to releasably lock said first shaft in a selected position along said tension rods.

17. A roller massager for simultaneously massaging opposite sides of bodily extremities, torso and back which comprises:

first and second spaced elongated shafts;

two spaced generally parallel tension rods having threaded portions penetrating through said first and second shafts;

two nuts threaded on each of said tension rods on opposite sides of said first shaft;

means for rotating said tension rods to move said first shaft in either direction along said tension rods at least one massage roller surrounding a central portion of each of said first and second shafts between said tension rods;

said massage rollers being rotatable relative to said shafts;

at least one of said first and second shafts having handle portions extending beyond tension rod penetration locations;

said second shaft being slidable along said tension rods; and compression spring means for biasing said second shaft toward said first shaft.

18. The roller massager according to claim 16 further including electric motor means for rotating said nuts on said tension rods in either direction to vary compression in said compression spring and vary the position of said second shaft.

19. The roller massager according to claim 17 further including latch means for increasing distance between said first and second shafts, including means for moving said second shaft in a direction compressing said compression spring means, and for releasably locking said second shaft in the resulting position, whereby a bodily extremity may be more easily extended between said first and second shafts.

* * * * *